US005590837A

United States Patent [19]

Grogan

[11] Patent Number: 5,590,837

[45] Date of Patent: Jan. 7, 1997

[54] SPRAYER HAVING VARIABLE SPRAY PATTERN

[75] Inventor: R. Pat Grogan, Downey, Calif.

[73] Assignee: Calmar Inc., City of Industry, Calif.

[21] Appl. No.: 395,851

[22] Filed: Feb. 28, 1995

[51] Int. Cl.[6] ..... B05B 1/34

[52] U.S. Cl. ..... 239/478; 239/490

[58] Field of Search ..... 239/461, 463, 239/476–479, 491, 538, 333, 486, 487, 489, 490

[56] References Cited

U.S. PATENT DOCUMENTS

| | | | |
|---|---|---|---|
| 555,573 | 3/1896 | Haas . | |
| 1,903,354 | 4/1933 | Backus . | |
| 3,843,030 | 10/1974 | Micallef | 239/478 X |
| 3,967,765 | 7/1976 | Micallef | 239/478 X |
| 3,994,442 | 11/1976 | Hoening | 239/472 |
| 4,020,982 | 5/1977 | Micallef | 222/554 |
| 4,189,064 | 2/1980 | O'Neill et al. | 222/321 |
| 4,234,128 | 11/1980 | Quinn et al. | 239/478 |
| 4,247,048 | 1/1981 | Hayes | 239/478 X |
| 4,358,057 | 11/1982 | Burke | 239/333 |
| 4,365,751 | 12/1982 | Saito et al. | 239/490 X |
| 4,516,695 | 5/1985 | Garneau | 239/478 X |
| 4,706,888 | 11/1987 | Dobbs | 239/478 |
| 4,890,792 | 1/1990 | Martin et al. | 239/478 X |
| 5,368,234 | 11/1994 | Foster et al. | 239/333 |

*Primary Examiner*—Lesley D. Morris

*Attorney, Agent, or Firm*—Watson Cole Stevens Davis, P.L.L.C.

[57] ABSTRACT

A sprayer has a nozzle assembly which includes first and second fluid flow paths, the latter partially negating the spin velocity produced from the first path to effect a spray having a narrower spray cone. The second fluid flow path is established by a through opening located in a spinner probe, which opening is blocked and unblocked upon relative rotation of a surrounding nozzle cap.

13 Claims, 1 Drawing Sheet

SPRAYER HAVING VARIABLE SPRAY PATTERN

RELATED APPLICATION

This invention relates to U.S. Ser. No. 08/326,230, filed Oct. 20, 1994, entitled Variable Discharge Sprayer,now Pat. No. 5,547,132 and commonly owned herewith.

BACKGROUND OF THE INVENTION

This invention relates generally to a pump sprayer of either the finger actuated or trigger actuated types, including a nozzle cap surrounding a spinner probe, the cap having spin mechanics of some known type for imparting a spin or swirl at a given velocity for issuance through the discharge orifice in a given spray pattern having a predetermined, divergent spray cone.

More particularly, the invention provides for varying the spray pattern by negating the spin velocity as product is directed from the discharge passage through an additional fluid path to the spin mechanics, this path being established by a through opening located in the probe. The second fluid path may be selectively opened and closed to regulate the size of the spray cone.

Known fingertip sprayers typically have a nozzle cap mounted within a reciprocable plunger head, the cap having spin mechanics and surrounding a spinner probe on the head. A fluid path from the discharge passage is established between the probe and a surrounding cap skirt to produce a dedicated spray pattern upon plunger reciprocation.

Known pump sprayers of the trigger actuated type, exemplified by U.S. Pat. No. 4,706,888, include a nozzle cap rotatable between spray-off and stream-off positions, without axial shifting, requiring radial and tangential channels at the end of the spinner probe for this purpose.

U.S. Pat. No. 5,368,234 discloses a nozzle assembly for a trigger sprayer which provides for regulation of the spray pattern by controlling the size of openings from a single fluid flow path into the swirl chamber upon cap rotation. A stream discharge is effected upon a shifting of the nozzle cap along its axis.

A nozzle cap which itself contains the spin mechanics simplifies the molding operation from which the pump sprayers are constructed, and avoids the need for a complex spinner probe structure.

In certain applications, it is desirable for the fingertip sprayer and/or for the trigger operated sprayer to provide a narrower spray cone using the existing spin mechanics structure molded into the nozzle cap, the less divergent spray cone satisfying the need for reducing the area of spray against a target of a given size to be wetted during pumping operation.

Also, it would be of a benefit to vary the size of the divergent spray cone by simply rotating the nozzle cap without axial displacement in a simple and efficient yet highly economical manner without complicating the structure and avoiding the need for additional molded parts.

SUMMARY OF THE INVENTION

It is an object of the present invention to provide a pump sprayer having an improved nozzle assembly capable of dispensing product upon pump actuation in a less divergent spray pattern by negating some of the tangential velocity imparted to the fluid at the discharge orifice as fluid is directed along a second fluid path from the discharge passage.

According to the invention, the spinner probe is provided with a through opening communicating at its downstream end with the spin mechanics, and at its upstream end with the discharge passage to establish the second fluid flow path for negating some of the tangential velocity at the spin mechanics to thereby reduce the size of the divergent spray pattern. The nozzle cap surrounds the probe and is mounted for rotation about its axis without axial displacement for selectively regulating the spray pattern as the nozzle cap is structured to block and uncover the through opening upon cap rotation.

The through opening in the probe has a terminal end at an outer surface of the probe within the cap skirt, a first section of an inner wall of the cap skirt blocking the terminal end in a first relative rotative position of the cap, and a second section of the inner wall of the cap skirt being spaced from the terminal end for unblocking the through opening in a second relative rotative position of the cap.

The inner wall of the skirt may be eccentric relative to the central axis of the probe, such that the first wall section in the first relative rotative position is tangent to the probe for covering the terminal end, and the through opening in the probe may extend at an angle relative to the central axis of the probe.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 4, 5, 6, 7:
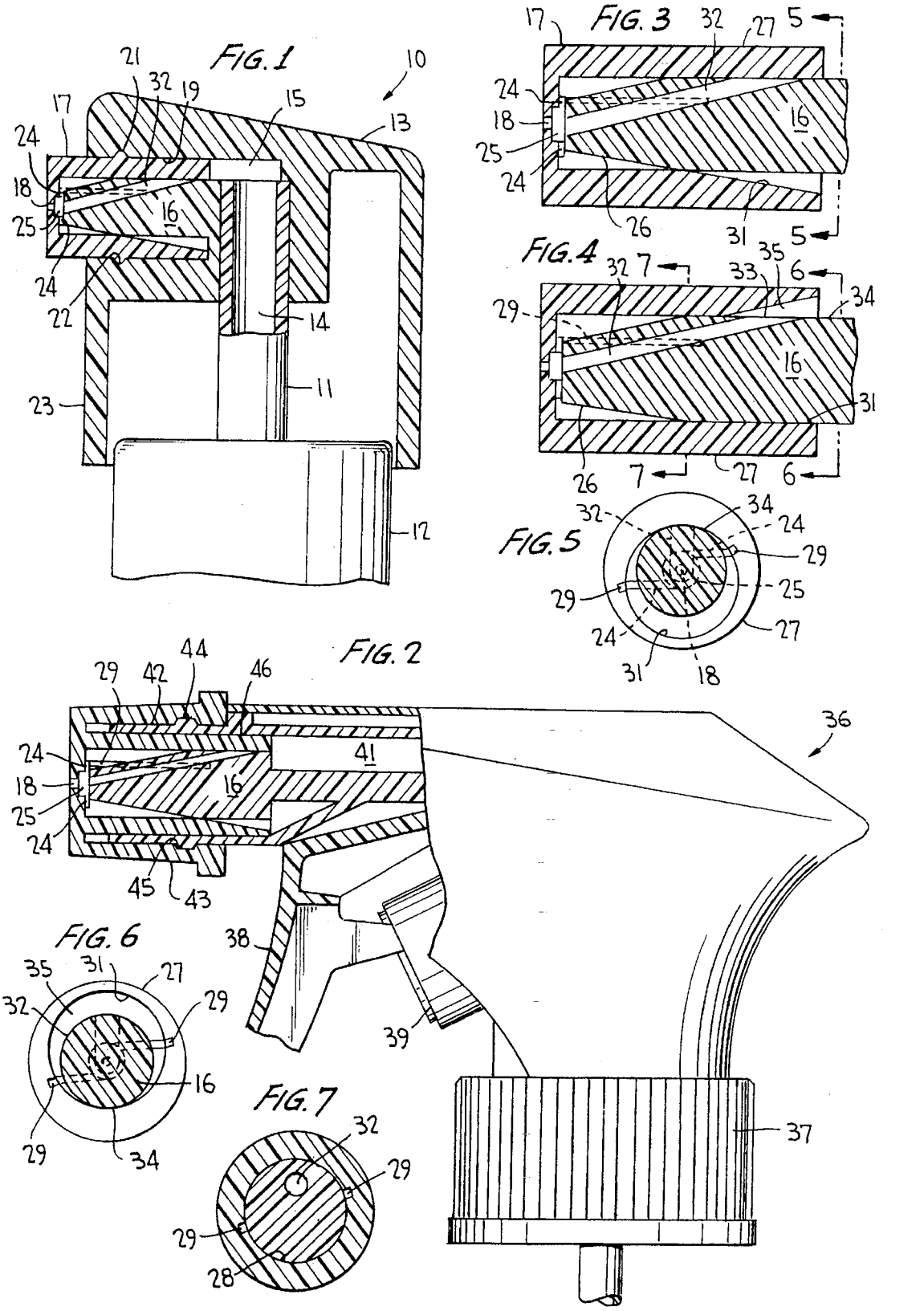
FIG 1 is a fragmentary vertical sectional view of a fingertip operated pump sprayer incorporating the present invention.
FIG 2 is a side view, partly in section, of a trigger actuated pump sprayer incorporating the invention.
FIG. 3 is a sectional view, at an enlarged scale, showing the details of the present invention with the cap rotated in a position blocking the second fluid flow path.
FIG 4 is a view similar to FIG. 3, showing the cap rotated to uncover the second fluid flow path.
FIG 5 is a view taken substantially along the line 5—5 of FIG. 3.
FIG. 6 is view taken substantially along the line 6—6 of FIG. 4.
FIG. 7 is a sectional view taken substantially along the line 7—7 of FIG. 4.

Turning now to the drawings wherein like reference characters refer to like and corresponding parts throughout the several views, a fingertip actuated pump sprayer is generally designated 10 in FIG. 1 as essentially comprising a pump body including a hollow piston stem 11 which extends through a central opening in a crown portion 12 of a container closure (not otherwise shown) for mounting the sprayer on a container (not shown) of liquid product to be dispensed upon pumping. The hollow stem of the pump piston extends for reciprocation within a pump cylinder (not shown) in the normal manner. The pump body further includes a plunger head 13 mounted on the stem to effect reciprocation upon application of a downward finger force applied to the top of the plunger head against the spring bias of the piston return spring (not shown).

The hollow piston stem defines a fluid discharge passage 14 which communicates at its upper end with a lateral pathway 15 in the head, and the head includes a transversely extending spinner probe 16 surrounded by a nozzle cap 17 having a coaxial discharge orifice 18.

The nozzle cap is sealingly mounted within an annular bore 19 of the plunger head for rotation about its central axis without axial displacement as by the provision of a cooperating bead 21 and groove 22 arrangement. The nozzle cap extends outwardly of the front circular face 23 of the plunger head to permit grasping by the operator for cap rotation.

The inner front face of the nozzle cap is provided with some type of known spin mechanics, including a plurality of tangential channels 24 terminating at the downstream end thereof in a central spin or swirl chamber 25 coaxial with the discharge orifice.

As shown in detail in FIGS. 3 and 4, probe 16 is generally cylindrical and may have a conically tapered forward end as at 26. Cylindrical cap skirt 27 has a generally cylindrical inner wall 28 (FIG. 7) surrounding tapered end 26 of the probe, wall 28 containing one or more longitudinal grooves 29 connecting with tangential channels 24 (FIG. 5).

Inner wall section 31 of the cap skirt which surrounds the cylindrical portion of the spinner probe is eccentrically shaped relative to the central axis of the cap, as shown in FIGS. 5, 6. In the relative rotative position of the nozzle cap of FIG 3 and , a portion of wall section 31 is tangent to the probe cylindrical section, and the remaining portion of the wall section 31 is spaced from the cylindrical portion of the probe.

Grooves 29 in the cylindrical portion of the cap skirt are offset relative to the tangency between wall portion 31 and the probe, as shown in FIGS. 5, 6, such that grooves 29 terminate in that portion of wall 31 which is spaced from the outer surface of the probe. Thus, grooves 29 establish a first fluid path between discharge passage 14 and the spin mechanics which imparts a spin at a given velocity to the fluid to be discharged through the discharge orifice in a spray pattern of a divergent spray cone or plume of a given conical size.

According to the invention, some of the spin velocity is negated to produce a less divergent spray cone. Similarly as in the aforementioned related application, the probe is provided with a through opening to establish a second fluid flow path from the discharge passage to the spin mechanics such that, during pumping, fluid flows along both the first and second fluid paths, and some of the spin velocity is negated by the latter to effect a discharge of fluid through orifice 18 as a divergent spray having a cone size more narrow than the size of the spay cone produced by the pumping of fluid only through the first fluid path via grooves 29.

The through opening 32 opens at its downstream or listed end essentially into the spin chamber and has an upstream terminal end 33 located at outer surface 34 at the cylindrical portion of the probe. As shown in FIGS. 3, 4, the through opening may lie at an angle to the central axis of the probe.

FIGS. 3 and 5 illustrate the relative rotative position of the nozzle cap wherein that section of its inner wall 31 is tangential to outer surface 34 of the probe at which terminal end 33 is located for covering the terminal end of the through opening to thereby block the second fluid flow path whereupon fluid reaches the spin mechanics during pumping only through the first fluid path to thereby issue through the discharge orifice as a wide divergent spray cone.

Upon relative rotation of the nozzle cap about its axis to the FIGS. 4, 6 position, inner wall 31 of the cap skirt presents a gap 35 in the vicinity of terminal end 33 whereupon the through opening is unblocked, permitting fluid to flow along both the first and the second flow paths for producing a less divergent spray cone as some of the tangential velocity at the spin mechanics is negated.

FIG. 2 illustrates a trigger actuated pump sprayer 36 which likewise incorporates the invention, the trigger sprayer being mounted on a container (not shown) of product to be dispensed by the provision of a closure cap 37. A trigger actuator 38 is hingedly mounted to the pump body as in a normal manner and engages a pump piston 39 for pumping product through discharge passage 41.

The pump body has an outwardly extending nozzle 42 into which probe 16 extends. Nozzle cap 43 surrounds the nozzle and is mounted thereon for relative rotation about its central axis, without axial displacement, by the provision of a cooperating bead and groove 44, 45. The end wall of the nozzle cap is the same as that of the nozzle cap 17 in that it includes discharge orifice 18 as well as tangential channels 24 opening into swirl cheer 25.

Nozzle cap 43 has an inner skirt 46 containing grooves 29 and having its inner wall structured relative to the probe the same as described with reference to FIG. 1.

Thus, cap rotation between the FIG. 3 and FIG. 4 positions regulates the spray pattern from a wide divergent spray to a less divergent spray in the same manner as described with reference to FIGS. 3 to 7.

Obviously, many other modifications and variations of the present invention are made possible in the light of the above teachings. It is therefore to be understood that within the scope of the appended claims the invention may be practiced otherwise than as specifically described.

What is claim is:

1. A pump sprayer comprising a pump body having a fluid discharge passage and a spinner probe, a nozzle cap on said probe, said cap having a discharge orifice and means including a spin chamber in communication with said orifice for imparting a spin at a given velocity to fluid to be discharged through said orifice in a spray pattern having a predetermined spray cone, means defining a first fluid path external to said probe and extending from said fluid passage to said orifice via said spin imparting means, the improvement wherein:

said probe has a through opening defining a second fluid path from said discharge passage to said spin chamber, said through opening extending at an angle relative to a central axis of said probe, between a distal end and an outer surface of said probe, said second fluid path being wholly independent of said first fluid path such that fluid flowing through said second fluid path negates the given velocity to produce a spray cone of reduced conicity compared to that of the predetermined spray cone.

2. The sprayer according to claim 1, wherein said cap has a skirt surrounding said probe, an inner surface of said skirt having longitudinally extending grooves defining said first fluid path.

3. The sprayer according to claim 1, wherein said nozzle cap is rotatable about said probe without axial displacement, said cap having a skirt surrounding said probe, an upstream end of said through opening having a terminal end at said outer surface of said probe within said skirt, a first section of an inner surface of said skirt blocking said terminal end in a first relative rotative position of said cap, and a second section of said inner surface being spaced from said terminal end for unblocking said through opening in a second relative position of said cap.

4. The sprayer according to claim 3, wherein the pump body comprises a hollow reciprocable piston stem defining the fluid discharge passage, and a plunger head mounted on said stem having said probe extending transversely from said stem, said cap extending outwardly of a front face of said plunger head to facilitate manual cap rotation.

5. The sprayer according to claim 3, wherein the pump body has an outwardly extending cylindrical nozzle surrounding said probe for supporting said nozzle cap, a trigger actuator mounted on said pump body, and said cap having an outer wall to facilitate manual cap rotation.

6. The sprayer according to claim 1, wherein said inner surface of said skirt is eccentric relative to the central axis of said probe, said first section in said first position being tangent to said probe.

7. The sprayer according to claim 1, wherein the pump body comprises a hollow reciprocable piston stem defining the fluid discharge passage, and a plunger head mounted on said stem having said probe extending transversely from said stem.

8. The sprayer according to claim 1, wherein the pump body has an outwardly extending, cylindrical nozzle surrounding said probe for supporting said nozzle cap, and a trigger actuator mounted on said pump body.

9. A nozzle assembly for a manually actuated pump sprayer comprising;

a sprayer body having a fluid discharge passage;

a sprayer probe on said body;

a nozzle cap mounted on said body only for rotation;

said cap having a discharge orifice and means including a spin chamber in communication with said orifice for imparting a spin at a given velocity to fluid to be discharged through said orifice as a fine mist spray having a predetermined divergent spray cone;

said cap having a skirt surrounding said probe, said skirt having means defining a first fluid path extending from said fluid passage to said orifice via said spin imparting means, and said skirt having a contoured inner wall which is eccentric relative to a central axis of said probe for covering and uncovering a terminal end of said through opening depending on the relative rotative position of said cap;

said probe having a through opening defining a second fluid path extending from said discharge passage to said spin chamber for negating the given velocity to produce a divergent spray of reduced conicity compared to that of the predetermined spray cone.

10. The sprayer according to claim 9, wherein said probe opening lies at an angle relative to the central axis of said probe.

11. The sprayer according to claim 9, wherein said means defining said first fluid path comprises at least one longitudinal groove in an inner wall of said skirt.

12. The sprayer according to claim 9, wherein the sprayer body comprises a hollow reciprocable piston defining the fluid discharge passage, and a plunger head mounted on said stem having said probe extending transversely from said stem, said cap extending outwardly of a front face of said plunger head to facilitate manual cap rotation.

13. The sprayer according to claim 9, wherein said pump body has an outwardly extending cylindrical nozzle surrounding said probe and supporting said nozzle cap, a trigger actuator mounted on said pump body, and said cap having an outer wall to facilitate manual cap rotation.

* * * * *